US011240885B2

(12) United States Patent
Fursa et al.

(10) Patent No.: US 11,240,885 B2
(45) Date of Patent: Feb. 1, 2022

(54) AEROSOL GENERATING DEVICE WITH INDUCTOR

(71) Applicant: Philip Morris Products S.A., Neuchatel (CH)

(72) Inventors: Oleg Fursa, Neuchatel (CH); Oleg Mironov, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 382 days.

(21) Appl. No.: 16/325,608

(22) PCT Filed: Jul. 7, 2017

(86) PCT No.: PCT/EP2017/067161
§ 371 (c)(1),
(2) Date: Feb. 14, 2019

(87) PCT Pub. No.: WO2018/041450
PCT Pub. Date: Mar. 8, 2018

(65) Prior Publication Data

US 2019/0182909 A1 Jun. 13, 2019

(30) Foreign Application Priority Data

Aug. 31, 2016 (EP) ..... 16186683

(51) Int. Cl.
*H05B 6/10* (2006.01)
*H05B 6/06* (2006.01)
(Continued)

(52) U.S. Cl.
CPC ..... *H05B 6/108* (2013.01); *A24F 40/465* (2020.01); *A24F 40/20* (2020.01)

(58) Field of Classification Search
CPC ..... A24F 40/20; A24F 40/465; H05B 6/108; H05B 6/105; H05B 6/36; H05B 6/06
(Continued)

(56) References Cited

U.S. PATENT DOCUMENTS 5,613,505 A 3/1997 Campbell et al.
2002/0078956 A1 6/2002 Sharpe et al.
(Continued)

FOREIGN PATENT DOCUMENTS

CN 1126426 A 7/1996
CN 101390659 A 3/2009
(Continued)

OTHER PUBLICATIONS

Notice of Allowance dated Dec. 18, 2020 in Russian Patent Application No. 2019107930 (with English translation), 15 pages.
(Continued)

*Primary Examiner* — Quang T Van
(74) *Attorney, Agent, or Firm* — Oblon, McClelland, Maier & Neustadt, L.L.P.

(57) ABSTRACT

There is provided an electrically operated aerosol-generating device for heating an aerosol-generating article including an aerosol-forming substrate by heating a susceptor element positioned to heat the substrate. The device includes a housing defining a chamber configured to receive at least a portion of the article, an inductor including an inductor coil disposed around at least a portion of the chamber, and a power source connected to the inductor coil and configured to provide a high frequency electric current to the inductor coil to generate a fluctuating electromagnetic field to heat the susceptor element and thereby heat the substrate. The inductor further includes a flux concentrator disposed around the inductor coil and configured to distort the fluctuating electromagnetic field towards the chamber. The flux
(Continued)

concentrator includes a plurality of discrete flux concentrator segments positioned adjacent to one another. An aerosol-generating system and an inductor assembly are also provided.

55 Claims, 6 Drawing Sheets

(51) Int. Cl.
*A24F 40/465* (2020.01)
*A24F 40/20* (2020.01)

(58) Field of Classification Search
USPC ..... 219/630, 620, 622, 511, 615, 628, 634, 219/635, 651
See application file for complete search history.

(56) References Cited

U.S. PATENT DOCUMENTS

| | | | | |
|---|---|---|---|---|
| 2012/0234315 | A1 | 9/2012 | Li et al. | |
| 2015/0245669 | A1 | 9/2015 | Cadieux et al. | |
| 2015/0320116 | A1 | 11/2015 | Bleloch et al. | |
| 2017/0055583 | A1 | 3/2017 | Blandino et al. | |
| 2017/0079326 | A1 | 3/2017 | Mironov | |
| 2018/0027883 | A1* | 2/2018 | Zuber | A61M 15/0028 |
| 2018/0279681 | A1* | 10/2018 | Rojo-Calderon | A24C 5/01 |
| 2020/0245682 | A1* | 8/2020 | Reevell | A24F 40/465 |

FOREIGN PATENT DOCUMENTS

| | | | |
|---|---|---|---|
| CN | 201445686 | U | 5/2010 |
| CN | 105407750 | A | 3/2016 |
| EP | 2 444 112 | A1 | 4/2012 |
| GB | 574914 | | 1/1946 |
| JP | H 08-511175 | A | 11/1996 |
| RU | 162 038 | U1 | 5/2016 |
| WO | WO 95/27411 | A1 | 10/1995 |
| WO | WO 2011/130104 | A1 | 10/2011 |
| WO | WO 2013/086004 | A1 | 6/2013 |
| WO | WO 2015/176898 | A1 | 11/2015 |
| WO | WO 2015/177253 | A1 | 11/2015 |
| WO | WO 2016/105705 | A1 | 6/2016 |
| WO | WO 2015/177294 | A1 | 11/2016 |
| WO | WO 2017/036955 | A2 | 3/2017 |
| WO | WO 2017/118553 | A1 | 7/2017 |
| WO | WO 2017/149093 | A1 | 9/2017 |
| WO | WO 2017/186455 | A1 | 11/2017 |
| WO | WO 2017/207443 | A1 | 12/2017 |
| WO | WO 2017/207580 | A1 | 12/2017 |
| WO | WO 2015/131058 | A1 | 9/2018 |

OTHER PUBLICATIONS

Russian Search Report dated Dec. 18, 2020 in Russian Patent Application No. 2019107930 (with English translation), 4 pages.
International Search Report and Written Opinion dated Jan. 29, 2018 in PCT/EP2017/067161 filed on Jul. 7, 2017.
Combined Chinese Office Action and Search Report dated Apr. 23, 2021 in Chinese Patent Application No. 201780050866.5 (with English translation), 19 pages.
Japanese Office Action dated Jul. 12, 2021 in corresponding Japanese Patent Application No. 2019-507167 (with English translation), 5 pages.

* cited by examiner

AEROSOL GENERATING DEVICE WITH INDUCTOR

The present invention relates to an electrically-operated aerosol-generating device for use in an electrically-operated aerosol-generating system and to an electrically-operated aerosol-generating system comprising such an electrically-operated aerosol-generating device.

A number of electrically-operated aerosol-generating systems in which an aerosol-generating device having an electric heater is used to heat an aerosol-forming substrate, such as a tobacco plug, have been proposed in the art. One aim of such aerosol-generating systems is to reduce known harmful smoke constituents of the type produced by the combustion and pyrolytic degradation of tobacco in conventional cigarettes. Typically, the aerosol-generating substrate is provided as part of an aerosol-generating article which is inserted into a chamber or cavity in the aerosol-generating device. In some known systems, to heat the aerosol-forming substrate to a temperature at which it is capable of releasing volatile components that can form an aerosol, a resistive heating element such as a heating blade is inserted into or around the aerosol-forming substrate when the article is received in the aerosol-generating device. In other aerosol-generating systems, an inductive heater is used rather than a resistive heating element. The inductive heater typically comprises an inductor forming part of the aerosol-generating device and a conductive susceptor element arranged such that it is in thermal proximity to the aerosol-forming substrate. The inductor generates a fluctuating electromagnetic field to generate eddy currents and hysteresis losses in the susceptor element, causing the susceptor element to heat up, thereby heating the aerosol-forming substrate. Inductive heating allows aerosol to be generated without exposing the heater to the aerosol-generating article. This can improve the ease with which the heater may be cleaned. However, with inductive heating, the inductor may also cause eddy currents and hysteresis losses in adjacent parts of the aerosol-generating device which are external to the inductor, or in other conductive items in close proximity to the aerosol-generating device. This can reduce the efficiency of the inductor, thus reducing the efficiency of the aerosol-generating device, and may also lead to undesirable heating of external components or adjacent items.

It would be desirable to provide an electrically-operating aerosol-generating device with improved efficiency and which reduces the opportunity for undesirable heating of adjacent items.

According to a first aspect of the present invention, there is provided an electrically operated aerosol-generating device for heating an aerosol-generating article including an aerosol-forming substrate by heating a susceptor element positioned to heat the aerosol-forming substrate, the device comprising: a device housing defining a chamber for receiving at least a portion of the aerosol-generating article; an inductor comprising an inductor coil disposed around at least a portion of the chamber; and a power source connected to the inductor coil and configured to provide a high frequency electric current to the inductor coil such that, in use, the inductor coil generates a fluctuating electromagnetic field to heat the susceptor element and thereby heat the aerosol-forming substrate, wherein the inductor further comprises a flux concentrator disposed around the inductor coil and configured to distort the fluctuating electromagnetic field, generated by the inductor coil during use, towards the chamber, and wherein the flux concentrator comprises a plurality of discrete flux concentrator segments.

Advantageously, by distorting the electromagnetic field towards the chamber, the flux concentrator can concentrate or focus the electromagnetic field within the chamber. This may increase the level of heat generated in the susceptor for a given level of power passing through the inductor coil in comparison to inductors in which a flux concentrator is not provided. Thus, the efficiency of the aerosol-generating device may be improved.

As used herein, the phrase 'concentrate the electromagnetic field' means that the flux concentrator is able to distort the electromagnetic field so that the density of the electromagnetic field is increased within the chamber.

Further, by distorting the electromagnetic field towards the chamber, the flux concentrator may also reduce the extent to which the electromagnetic field propagates beyond the inductor.

In other words, the flux concentrator may act as an electromagnetic shield. This may reduce undesired heating of adjacent conductive parts of the device, for example if a metallic outer housing is used, or of adjacent conductive items external to the device. By reducing undesired heating and losses from the inductor coil, the efficiency of the aerosol-generating device may be further improved.

As used herein, the term 'aerosol-forming substrate' relates to a substrate capable of releasing volatile compounds that can form an aerosol. Such volatile compounds may be released by heating the aerosol-forming substrate. An aerosol-forming substrate may conveniently be part of an aerosol-generating article.

As used herein, the term 'aerosol-generating article' refers to an article comprising an aerosol-forming substrate that is capable of releasing volatile compounds that can form an aerosol. For example, an aerosol-generating article may be an article that generates an aerosol that is directly inhalable by the user drawing or puffing on a mouthpiece at a proximal or user-end of the system. An aerosol-generating article may be disposable. An article comprising an aerosol-forming substrate comprising tobacco is referred to as a tobacco stick.

As used herein, the term "aerosol-generating device" refers to a device that interacts with an aerosol-generating article to generate an aerosol.

As used herein, the term "aerosol-generating system" refers to the combination of an aerosol-generating article as further described and illustrated herein with an aerosol-generating device as further described and illustrated herein. In the system, the article and the device cooperate to generate a respirable aerosol.

As used herein, the term "flux concentrator" refers to a component having a high relative magnetic permeability which acts to concentrate and guide the electromagnetic field or electromagnetic field lines generated by an inductor coil.

As used herein and within the art, the term "relative magnetic permeability" refers to the ratio of the magnetic permeability of a material, or of a medium, such as the flux concentrator, to the magnetic permeability of free space, "$\mu_0$", where $\mu_0$ is $4\pi\times10^{-7}$ N $A^{-2}$.

As used herein, the term "high relative magnetic permeability" refers to a relative magnetic permeability of at least 5 at 25 degrees Celsius, for example at least 10, at least 20, at least 30, at least 40, at least 50, at least 60, at least 80, or at least 100. These example values preferably refer to the values of relative magnetic permeability for a frequency of between 6 and 8 MHz and a temperature of 25 degrees Celsius.

As used herein, the term "high frequency oscillating current" means an oscillating current having a frequency of between 500 kHz and 10 MHz.

The flux concentrator preferably comprises a material or combination of materials having a relative magnetic permeability of at least 5 at 25 degrees Celsius, preferably at least 20 at 25 degrees Celsius. The flux concentrator may be formed from a plurality of different materials. In such embodiments, the flux concentrator, as an overall medium, may have a relative magnetic permeability of at least 5 at 25 degrees Celsius, preferably at least 20 at 25 degrees Celsius. These example values preferably refer to the values of relative magnetic permeability for a frequency of between 6 and 8 MHz and a temperature of 25 degrees Celsius.

The flux concentrator may be formed from any suitable material or combination of materials. Preferably, the flux concentrator comprises a ferromagnetic material, for example a ferrite material, a ferrite powder held in a binder, or any other suitable material including ferrite material such as ferritic iron, ferromagnetic steel or stainless steel.

The thickness of the flux concentrator will depend on the material or combination of materials from which it is made, as well as the shape of the inductor coil and of the flux concentrator and on the desired level of electromagnetic field distortion. Careful selection of the flux concentrator material and dimensions allows the shape and density of the electromagnetic field to be tuned according to the heating and power requirements of the susceptor element or susceptor elements with which the inductor will be coupled during use. This "tuning" of the flux concentrator may allow a predetermined value of electromagnetic field strength to be achieved within the chamber. For example, the flux concentrator may have a thickness of from 0.3 mm to 5 mm, preferably from 0.5 mm to 1.5 mm. In certain embodiments, the flux concentrator comprises ferrite and has a thickness of from 0.3 mm to 5 mm, preferably from 0.5 mm to 1.5 mm.

As used herein, the term "thickness" refers to the dimension in the transverse direction of a component of the aerosol-generating device or of the aerosol-generating article at a particular location along its length or around its circumference. When referring specifically to the flux concentrator, the term 'thickness' refers to half the difference between the outer diameter and inner diameter of the flux concentrator at a particular location.

As used herein, the term 'longitudinal' is used to describe the direction along the main axis of the aerosol-generating device or of the aerosol-generating article and the term 'transverse' is used to describe the direction perpendicular to the longitudinal direction.

The thickness of the flux concentrator may be substantially constant along its length. In other examples, the thickness of the flux concentrator may vary along its length. For example, the thickness of the flux concentrator may taper, or decrease, from one end to another, or from a central portion of the flux concentrator towards both ends. Where the thickness of the flux concentrator varies along its length, either of the outer diameter or the inner diameter may remain substantially constant along the length of the flux concentrator. In certain embodiments, the inner diameter of the flux concentrator is substantially constant along its length while the outer diameter decreases from one end of the flux concentrator towards the other. Such flux concentrators can be said to have a "wedge-shaped" longitudinal cross-section.

The thickness of the flux concentrator may be substantially constant around its circumference. In other examples, the thickness of the flux concentrator may vary around its circumference.

The flux concentrator may have any suitable shape, based on the shape of the inductor coil and the desired level of distortion of the electromagnetic field. The flux concentrator may extend along only part of the length of the inductor coil. Preferably, the flux concentrator extends along substantially the entire length of the inductor coil. The flux concentrator may extend beyond the inductor coil at one or both ends of the inductor coil.

The flux concentrator may extend around only part of the circumference of the inductor coil. Preferably, the flux concentrator is tubular. In such embodiments, the flux concentrator completely circumscribes the inductor coil along at least part of the length of the coil. The flux concentrator may be cylindrical. In such embodiments, the flux concentrator is tubular and its thickness is substantially constant along its length. Where the flux concentrator is tubular, it may have any suitable cross-section. For example, the flux concentrator may have a square, oval, rectangular, triangular, pentagonal, hexagonal, or similar cross-sectional shape. Preferably, the flux concentrator has a circular cross-section. For example, the flux concentrator may have a circular, cylindrical shape. In other words, the flux concentrator may be a cylindrical annulus.

The flux concentrator comprises a plurality of discrete flux concentrator segments positioned adjacent to one another. Thus, the flux concentrator is an assembly of multiple, separate components. This allows the flux concentrator, and thus the degree to which the electromagnetic field is distorted, to be tuned by removing or adding one or more flux concentrator segments to the flux concentrator. For example, one or more flux concentrator segments may be replaced with a segment formed from a material having a lower relative magnetic permeability, such as plastic, to reduce the degree to which the electromagnetic field is distorted by the flux concentrator. This "tuning" of the flux concentrator may allow a predetermined value of electromagnetic field strength to be achieved within the chamber, for example at the location in which the susceptor element will be located in use.

As used herein, the term "adjacent" is used to mean "alongside", or "next to". This includes arrangements in which the segments are in direct contact as well as arrangements in which two or more of the segments are separated by a gap, such as an air gap or a gap containing one or more intermediate components between adjacent segments.

Any number of discrete flux concentrator segments may be provided based on the desired degree of tuning. For example, providing a larger number of smaller segments in order to form the flux concentrator may allow finer tuning of the electromagnetic field distortion provided by the flux concentrator, relative to flux concentrators comprising fewer, larger segments. The plurality of flux concentrator segments may comprise two discrete flux concentrator segments, or more than two, such as three, four, five, six, seven, eight, nine, ten, or more flux concentrator segments.

The plurality of flux concentrator segments may have a uniform size and shape. In other examples, one or more of the plurality of flux concentrator segments may have a different size, shape, or size and shape relative to one or more of the other flux concentrator segments. This allows simple tuning of the flux concentrator by swapping one or more of the segments with segments having different dimensions.

Where the flux concentrator comprises a plurality of discrete flux concentrator segments positioned adjacent to one another, the discrete flux concentrator segments may be made from the same material or combination of materials as each other. In such embodiments, the flux concentrator may be tuned by using flux concentrator segments with different dimensions.

Preferably, the plurality of flux concentrator segments includes a first flux concentrator segment formed from a first material and a second flux concentrator segment formed from a second, different material, wherein the first and second materials have different values of relative magnetic permeability. This allows the flux concentrator to be tuned during assembly to achieve a desired level of induction from the inductor coil and a desired level of electromagnetic flux in the chamber without necessarily changing the dimensions of the flux concentrator. Each of the flux concentrator segments could be made from a different material, or from the same material, or from any number of combinations in between.

The shape of the flux concentrator segments is selected based on the desired shape of the resulting flux concentrator.

In certain embodiments, the plurality of flux concentrator segments are tubular and are positioned coaxially along the length of the flux concentrator. In such embodiments, the resulting flux concentrator is tubular and completely circumscribes the inductor coil along at least part of the length of the coil. The tubular flux concentrator segments may be cylindrical. In other embodiments, the thickness of one or more of the tubular segments may vary along its length. Where the flux concentrator segments are tubular, they may have any suitable cross-section. For example, the tubular flux concentrator segments may have a square, oval, rectangular, triangular, pentagonal, hexagonal, or similar cross-sectional shape, according to the desired shape of the resulting flux concentrator. Preferably, the tubular flux concentrator segments each have a circular cross-section. For example, the tubular flux concentrator segments may have a circular, cylindrical shape. In other words, the tubular flux concentrator segments may each form a cylindrical annulus.

In certain other embodiments, the plurality of flux concentrator segments are elongate and are positioned around the circumference of the flux concentrator. As used herein, the term 'elongate' refers to a component having a length which is greater than both its width and thickness, for example twice as great. The elongate flux concentrator segments may have any suitable cross-section. For example, the elongate flux concentrator segments may have a square, oval, rectangular, triangular, pentagonal, hexagonal, or similar cross-sectional shape, according to the desired shape of the resulting flux concentrator. The elongate flux concentrator segments may have a planar, or flat, cross-sectional area. The elongate flux concentrator segments may have an arc-shaped cross-section. This may be particularly beneficial where the induction coil has a curved outer surface, for example where the inductor coil has a circular cross-section, since it allows the elongate flux concentrator segments to closely follow the outer shape of the inductor coil, reducing the overall dimensions of the inductor and of the device itself.

Where the plurality of flux concentrator segments are elongate and are positioned around the circumference of the flux concentrator, the elongate segments may be arranged such that their respective longitudinal axes are non-parallel. In preferred embodiments, the plurality of elongate flux concentrator segments are arranged such that their longitudinal axes are substantially parallel. The plurality of elongate flux concentrator segments may be arranged such that their longitudinal axes are at an angle to, that is, non-parallel with, the magnetic axis of the inductor coil. For example, the elongate segments may be arranged such that their respective longitudinal axes are non-parallel to each other and non-parallel to the magnetic axis.

In preferred embodiments, the plurality of elongate flux concentrator segments are arranged such that their longitudinal axes are substantially parallel with the magnetic axis of the inductor coil.

The plurality of flux concentrator segments may be fixed directly to the inductor coil, for example using an adhesive. The inductor may further comprise one or more intermediate components between the inductor coil and the flux concentrator segments by which the segments are retained in position relative to the inductor coil. For example, the inductor may further comprise an outer sleeve, circumscribing the inductor coil, to which the segments are attached. The outer sleeve may have a number of slots or recesses within which the segments are held. Where the flux concentrator segments are annular, the recesses may be annular and arranged to retain the annular segments.

Where the plurality of flux concentrator segments are elongate and are positioned around the circumference of the flux concentrator, the inductor preferably further comprises an outer sleeve circumscribing the inductor coil and having a plurality of longitudinal slots in which the elongate flux concentrator segments are held.

The elongate flux concentrator segments may be fixed in position relative to the outer sleeve. For example, the segments may be attached to the outer sleeve using adhesive.

Preferably, the elongate flux concentrator segments are slidably held in the longitudinal slots such that the longitudinal position of the elongate flux concentrator segments relative to the inductor coil may be selectively varied. This may allow further tuning of the flux concentrator to achieve a desired electromagnetic field within the chamber. The elongate flux concentrator segments may be slidably held in the longitudinal slots by one or more non-adhesive retaining means associated with each longitudinal slot and arranged to engage with an outer surface of the elongate segment received in the slot to prevent radial removal of the segment from the slot. For example, the outer sleeve may comprise one or more non-adhesive retaining means for each longitudinal slot in the form of a retaining tab or clip extending partially across the width of the slot or a retaining strip extending across the full width of the slot to retain the radial position of the segment relative to the outer sleeve while allowing longitudinal movement of the segment relative to the outer sleeve.

Preferably, the longitudinal slots have a length greater than the length of the elongate segments. With this arrangement, the segment may be supported by the slot, even when its longitudinal position relative to the outer sleeve is altered. In other examples, the slots may be open-ended so that the segments may partially extend beyond the slots when their longitudinal positions are altered.

The elongate segments may have a substantially constant thickness along their respective lengths. In other examples, the thickness of the elongate segments may vary along their respective lengths. For example, the thickness of the segments may taper, or decrease, from one end to another, or from a central portion of the segment towards both ends. In preferred embodiments, the elongate flux concentrator segments are wedge-shaped. This means that the thickness reduces gradually along the length of the segment from one end to the other. With this arrangement, the level of electromagnetic field distortion provided by the flux concentrator can be varied by altering the longitudinal position of one or more of the elongate segments relative to the outer sleeve.

The elongate flux concentrator segments may be arranged on the outer sleeve such that they are each separated by a gap. In other examples, two or more of the flux concentrator segments may be in direct contact with one or both of the adjacent flux concentrator segments.

In any of the above embodiments, the inductor may be embedded within the housing of the device, for example the inductor coil and the flux concentrator may be moulded into the material from which the housing is formed.

Preferably, the inductor further comprises an inner sleeve having an outer surface on which the inductor coil is supported. With this arrangement, the inductor coil may be wrapped around the inner sleeve during assembly. The inner surface of the inner sleeve may define the side walls of the chamber along at least part of the length of the chamber. The inner sleeve may be made from any suitable material, such as a plastic. The inner sleeve may be integral with the device housing. The inner sleeve may be a separate component which is connected the device housing. The inner sleeve may be removable from the device housing, for example to allow for servicing or replacement of the inductor assembly.

The inner sleeve preferably comprises at least one protrusion on its outer surface at one or both ends of the inductor coil for retaining the inductor coil on the inner sleeve. The at least one protrusion prevents or reduces longitudinal movement of the inductor coil relative to the inner sleeve. Preferably, the at least one protrusion is provided on the inner sleeve at both ends of the inductor coil. The at least one protrusion may comprise a plurality of protrusions at either end of the inductor coil, for example arranged in a pattern. The plurality of protrusions may comprise a single protrusion at either end of the inductor coil. The at least one protrusion may comprise a protrusion extending around the entire circumference of the inner sleeve at either end of the inductor coil.

The at least one protrusion extends radially from the outer surface. Preferably, the at least one protrusion extends above the outer surface by a distance which is greater than the thickness of the inductor coil. In this manner, the at least one protrusion extends above the inductor coil to prevent longitudinal movement of the inductor coil past the at least one protrusion. Where the inductor further comprises an outer sleeve to which a plurality of flux concentrator segments are connected, the at least one protrusion is preferably arranged to retain the outer sleeve in position. For example, the at least one protrusion preferably extends above the outer surface by a distance which is greater than the combined thickness of the inductor coil and the outer sleeve. In this manner, the at least one protrusion may abut either or both ends of both the outer sleeve and the inductor coil to prevent longitudinal movement of either relative to the inner sleeve.

Preferably, the aerosol-generating device is portable. The aerosol-generating device may have a size comparable to a conventional cigar or cigarette. The aerosol-generating device may have a total length between approximately 30 mm and approximately 150 mm. The aerosol-generating device may have an external diameter between approximately 5 mm and approximately 30 mm.

The power source may be a battery, such as a rechargeable lithium ion battery. Alternatively, the power source may be another form of charge storage device such as a capacitor. The power source may require recharging. The power source may have a capacity that allows for the storage of enough energy for one or more uses of the device. For example, the power source may have sufficient capacity to allow for the continuous generation of aerosol for a period of around six minutes, corresponding to the typical time taken to smoke a conventional cigarette, or for a period that is a multiple of six minutes. In another example, the power source may have sufficient capacity to allow for a predetermined number of puffs or discrete activations.

The aerosol-generating device may further comprise electronics configured to control the supply of power to the inductor from the power source. The electronics may be configured to disable operation of the device by preventing the supply of power to the inductor and may enable operation of the device by allowing the supply of power to the inductor.

The device may comprise one or more susceptor elements within the chamber which are arranged to heat the aerosol-forming substrate of an aerosol-generating article received in the chamber. For example, the device may comprise one or more susceptor elements formed in the same manner as described below in relation to the aerosol-generating article. The device may comprise one or more external susceptor elements configured to remain outside of an aerosol-generating article received in the cavity and to heat the aerosol-forming substrate of the aerosol-generating article when energised by the inductor coil. For example, the one or more external susceptor elements may extend at least partially around the circumference of the aerosol-generating article. The device may comprise one or more internal susceptor elements configured to extend at least partially into an aerosol-generating article received in the cavity and to heat the aerosol-forming substrate of the aerosol-generating article when energised by the inductor coil.

For example, the one or more internal susceptor elements may be arranged to penetrate the aerosol-forming substrate of the aerosol-generating article when the aerosol-generating article is received in the chamber. The one or more susceptor elements may comprise a susceptor blade within the chamber. The device may comprise one or more external susceptor elements and one or more internal susceptor elements, as described above.

Where the device comprises one or more susceptor elements within the chamber, the one or more susceptor elements may be fixed to the device. The one or more susceptor elements may be removable from the device. This may allow the one or more susceptor elements to be replaced independently of the device. For example, the one or more susceptor elements may be removable as one or more discrete components, or as part of a removable inductor assembly. The device may comprise a plurality of susceptor elements within the chamber. The plurality of susceptor elements within the chamber may be fixed within the chamber. One or more of the plurality of susceptor elements may be removable from the device such that they may be replaced. The plurality of susceptor elements may be removable individually or together with one or more of the other susceptor elements.

The device housing may be elongate. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle.

The device housing may comprise a mouthpiece. The mouthpiece may comprise at least one air inlet and at least one air outlet. The mouthpiece may comprise more than one air inlet. One or more of the air inlets may reduce the temperature of the aerosol before it is delivered to a user and may reduce the concentration of the aerosol before it is delivered to a user. As used herein, the term "mouthpiece" refers to a portion of an aerosol-generating device that is placed into a user's mouth in order to directly inhale an aerosol generated by the aerosol-generating device from an aerosol-generating article received in the chamber of the housing.

The aerosol-generating device may include a user interface to activate the device, for example a button to initiate heating of the device or display to indicate a state of the device or of the aerosol-forming substrate.

According to a second aspect of the present invention, there is provided an electrically operated aerosol-generating system comprising an electrically operated aerosol-generating device according to any of the embodiments described above, an aerosol-generating article including an aerosol-forming substrate, and a susceptor element positioned to heat the aerosol-forming substrate during use, wherein the aerosol-generating article is at least partially received in the chamber and arranged therein such that the susceptor element is inductively heatable by the inductor of the aerosol-generating device to heat the aerosol-forming substrate of the aerosol-generating article received in the chamber.

Preferably, the aerosol-forming substrate comprises a tobacco-containing material including volatile tobacco flavour compounds which are released from the aerosol-forming substrate upon heating. Alternatively, the aerosol-forming substrate may comprise a non-tobacco material. The aerosol-forming substrate may further comprise an aerosol former that facilitates the formation of a dense and stable aerosol. As used herein, the term 'aerosol former' is used to describe any suitable known compound or mixture of compounds that, in use, facilitates formation of an aerosol. Suitable aerosol formers are substantially resistant to thermal degradation at the operating temperature of the aerosol-generating article. Examples of suitable aerosol formers are glycerine and propylene glycol.

The aerosol-forming substrate may be a solid aerosol-forming substrate. Alternatively, the aerosol-forming substrate may comprise both solid and liquid components.

In a particularly preferred embodiment, the aerosol-forming substrate comprises a gathered crimped sheet of homogenised tobacco material. As used herein, the term 'crimped sheet' denotes a sheet having a plurality of substantially parallel ridges or corrugations.

The aerosol-generating article may comprise a susceptor element positioned to heat the aerosol-forming substrate during use. The susceptor element is a conductor that is capable of being inductively heated. A susceptor element is capable of absorbing electromagnetic energy and converting it to heat. In use, the changing electromagnetic field generated by the inductor coil heats the susceptor element, which then transfers the heat to the aerosol-forming substrate of the aerosol-forming article, mainly by conduction. The susceptor element may be configured to heat the aerosol-forming substrate by at least one of conductive heat transfer, convective heat transfer, radiative heat transfer, and combinations thereof. For this, the susceptor is in thermal proximity to the material of the aerosol forming substrate. Form, kind, distribution and arrangement of the susceptor may be selected according to a user's need.

The susceptor element may have a length dimension that is greater than its width dimension or its thickness dimension, for example greater than twice its width dimension or its thickness dimension. Thus the susceptor element may be described as an elongate susceptor element. The susceptor element is arranged substantially longitudinally within the rod. This means that the length dimension of the elongate susceptor element is arranged to be approximately parallel to the longitudinal direction of the rod, for example within plus or minus 10 degrees of parallel to the longitudinal direction of the rod. In preferred embodiments, the elongate susceptor element may be positioned in a radially central position within the rod, and extends along the longitudinal axis of the rod.

The susceptor element is preferably in the form of a pin, rod, blade, or plate. The susceptor element preferably has a length of between 5 mm and 15 mm, for example between 6 mm and 12 mm, or between 8 mm and 10 mm. The susceptor element preferably has a width of between 1 mm and 5 mm and may have a thickness of between 0.01 mm and 2 mm. for example between 0.5 mm and 2 mm. A preferred embodiment may have a thickness of between 10 micrometres and 500 micrometres, or even more preferably between 10 and 100 micrometres. If the susceptor element has a constant cross-section, for example a circular cross-section, it has a preferable width or diameter of between 1 mm and 5 mm.

The susceptor element may be formed from any material that can be inductively heated to a temperature sufficient to generate an aerosol from the aerosol-forming substrate. Preferred susceptor elements comprise a metal or carbon. A preferred susceptor element may comprise a ferromagnetic material, for example ferritic iron, or a ferromagnetic steel or stainless steel. A suitable susceptor element may be, or comprise, aluminium. Preferred susceptor elements may be formed from 400 series stainless steels, for example grade 410, or grade 420, or grade 430 stainless steel. Different materials will dissipate different amounts of energy when positioned within electromagnetic fields having similar values of frequency and field strength. Thus, parameters of the susceptor element such as material type, length, width, and thickness may all be altered to provide a desired power dissipation within a known electromagnetic field.

Preferred susceptor elements may be heated to a temperature in excess of 250 degrees Centigrade. Suitable susceptor elements may comprise a non-metallic core with a metal layer disposed on the non-metallic core, for example metallic tracks formed on a surface of a ceramic core.

A susceptor element may have a protective external layer, for example a protective ceramic layer or protective glass layer encapsulating the susceptor element. The susceptor element may comprise a protective coating formed by a glass, a ceramic, or an inert metal, formed over a core of susceptor material.

The susceptor element is arranged in thermal contact with the aerosol-forming substrate. Thus, when the susceptor element heats up the aerosol-forming substrate is heated up and an aerosol is formed. Preferably the susceptor element is arranged in direct physical contact with the aerosol-forming substrate, for example within the aerosol-forming substrate.

The aerosol-generating article may contain a single susceptor element. Alternatively, the aerosol-generating article may comprise more than one susceptor element.

The aerosol-generating article and the chamber of the device may be arranged such that the article is partially received within the chamber of the aerosol-generating device. The chamber of the device and the aerosol-generating article may be arranged such that the article is entirely received within the chamber of the aerosol-generating device.

The aerosol-generating article may be substantially cylindrical in shape. The aerosol-generating article may be substantially elongate. The aerosol-generating article may have a length and a circumference substantially perpendicular to the length. The aerosol-forming substrate may be provided as an aerosol-forming segment containing an aerosol-forming substrate. The aerosol-forming segment may be substantially cylindrical in shape. The aerosol-forming segment may be substantially elongate. The aerosol-forming segment may also have a length and a circumference substantially perpendicular to the length.

The aerosol-generating article may have a total length between approximately 30 mm and approximately 100 mm. In one embodiment, the aerosol-generating article has a total length of approximately 45 mm. The aerosol-generating article may have an external diameter between approximately 5 mm and approximately 12 mm. In one embodiment, the aerosol-generating article may have an external diameter of approximately 7.2 mm.

The aerosol-forming substrate may be provided as an aerosol-forming segment having a length of between about 7 mm and about 15 mm. In one embodiment, the aerosol-forming segment may have a length of approximately 10 mm. Alternatively, the aerosol-forming segment may have a length of approximately 12 mm.

The aerosol-generating segment preferably has an external diameter that is approximately equal to the external diameter of the aerosol-generating article. The external diameter of the aerosol-forming segment may be between approximately 5 mm and approximately 12 mm. In one embodiment, the aerosol-forming segment may have an external diameter of approximately 7.2 mm.

The aerosol-generating article may comprise a filter plug. The filter plug may be located at a downstream end of the aerosol-generating article. The filter plug may be a cellulose acetate filter plug. The filter plug is approximately 7 mm in length in one embodiment, but may have a length of between approximately 5 mm to approximately 10 mm.

The aerosol-generating article may comprise an outer paper wrapper. Further, the aerosol-generating article may comprise a separation between the aerosol-forming substrate and the filter plug. The separation may be approximately 18 mm, but may be in the range of approximately 5 mm to approximately 25 mm.

The aerosol-generating system is a combination of an aerosol-generating device and one or more aerosol-generating articles for use with the device. However, aerosol-generating system may include additional components, such as for example a charging unit for recharging an on-board electric power supply in an electrically operated or electric aerosol-generating device.

The aerosol-generating device includes an inductor comprising an inductor coil and a flux concentrator disposed around the inductor coil. The inductor may be an integral part of the aerosol-generating device. The inductor may be a discrete component which is removable from the rest of the aerosol-generating device. This enables the inductor to be replaced independently of the remaining components of the aerosol-generating device.

According to a third aspect of the present invention, there is provided an inductor assembly for an electrically operated aerosol-generating device, the inductor assembly defining a chamber for receiving at least a portion of an aerosol-generating article and comprising an inductor coil disposed around at least a portion of the chamber, and a flux concentrator disposed around the inductor coil and configured to distort a fluctuating electromagnetic field generated by the inductor coil during use towards the chamber, wherein the flux concentrator comprises a plurality of discrete flux concentrator segments positioned adjacent to one another.

Also provided is a kit comprising an aerosol-generating device according to the first aspect of the invention and a plurality of inductor assemblies according to the third aspect.

According to a fourth aspect of the present invention, there is provided an electrically operated aerosol-generating device for heating an aerosol-generating article including an aerosol-forming substrate by heating a susceptor element positioned to heat the aerosol-forming substrate, the device comprising: a device housing defining a chamber for receiving at least a portion of the aerosol-generating article; an inductor comprising an inductor coil disposed around at least a portion of the chamber; and a power source connected to the inductor coil and configured to provide a high frequency electric current to the inductor coil such that, in use, the inductor coil generates a fluctuating electromagnetic field to heat the susceptor element and thereby heat the aerosol-forming substrate, wherein the inductor further comprises a flux concentrator disposed around the inductor coil and configured to distort the fluctuating electromagnetic field, generated by the inductor coil during use, towards the chamber, and wherein the inductor further comprises a cushioning element positioned between the flux concentrator and the device housing.

As used herein, the term "cushioning element" refers to a resilient component which is configured to deform during an impact to absorb kinetic energy and thereby reduce the severity of any shock transferred to the flux concentrator by the device housing during the impact.

With this arrangement, the cushioning element reduces the risk of breakage of the flux concentrator during manufacture, transport, handling and use. It may also allow the thickness of the flux concentrator to be reduced. Reducing the thickness of the flux concentrator may allow the overall size and weight of the aerosol-generating device to be reduced and may allow such devices to be manufactured more cost effectively and using less raw material.

The cushioning element may comprise a single component, or may comprise a plurality of discrete cushioning elements. The cushioning element may comprise a plurality of discrete cushioning elements spaced around the circumference of the flux concentrator. The cushioning element may comprise a plurality of discrete cushioning elements spaced along the length of the flux concentrator.

In certain embodiments, the cushioning element extends around substantially the entire circumference of the flux concentrator. The term "substantially the entire circumference of the flux concentrator" means at least 90 percent of the outer circumference of the flux concentrator, preferably at least 95 percent, more preferably at least 97 percent of the outer circumference of the flux concentrator. In such embodiments, the cushioning element may comprise one or more resilient O-rings extending around the outer circumference of the flux concentrator.

In preferred embodiments, the cushioning element is bonded to substantially the entire outer surface of the flux concentrator. The term "substantially the entire outer surface of the flux concentrator" refers to at least 90 percent of the outer surface area of the flux concentrator, preferably at least 95 percent, more preferably at least 97 percent of the outer surface area of the flux concentrator.

With this arrangement, relative movement between the flux concentrator and the cushioning element may be avoided to ensure correct performance of the cushioning element. Further, by bonding the cushioning element to the flux concentrator, the performance of the flux concentrator may be maintained even if the flux concentrator is inadvertently fractured during an impact. This is because the fractured pieces of the flux concentrator will be held by the cushioning element in substantially the same place as prior to fracture.

In particularly preferred embodiments, the flux concentrator is encased within the cushioning element. As used herein, the term "encased" means that the flux concentrator is enclosed within the cushioning element in a close-fitting relationship such that relative movement between the flux concentrator and the cushioning element is substantially prevented. This arrangement has been found to provide a particularly protective environment for the flux concentrator.

The flux concentrator may be in direct contact with the cushioning element, or may be in indirect contact via one or more intermediate layers. For example, where aerosol-generating devices or inductor assemblies according to the invention comprise an electrically conductive shield disposed around the flux concentrator, the cushioning element may be in contact with the flux concentrator via the electrically conductive shield. In other words, when the inductor is installed in the aerosol-generating device, the cushioning element is disposed between the device housing and both the flux concentrator and the electrically conductive shield.

The cushioning element may be formed of any suitable resilient material or materials.

In certain embodiments, the cushioning element is formed from one or more of silicone, epoxy resin, a rubber or another elastomer.

According to a fifth aspect of the present invention, there is provided an electrically operated aerosol-generating system comprising an electrically operated aerosol-generating device according to any of the embodiments described above in relation to the fourth aspect of the invention, an aerosol-generating article including an aerosol-forming substrate, and a susceptor element positioned to heat the aerosol-forming substrate during use, wherein the aerosol-generating article is at least partially received in the chamber and arranged therein such that the susceptor element is inductively heatable by the inductor of the aerosol-generating device to heat the aerosol-forming substrate of the aerosol-generating article received in the chamber. According to a sixth aspect of the present invention, there is provided an inductor assembly for an electrically operated aerosol-generating device, the inductor assembly defining a chamber for receiving at least a portion of an aerosol-generating article and comprising an inductor coil disposed around at least a portion of the chamber, a flux concentrator disposed around the inductor coil and configured to distort a fluctuating electromagnetic field generated by the inductor coil during use towards the chamber, and a cushioning element positioned on an outer surface of the flux concentrator.

The cushioning element may comprise a single component, or may comprise a plurality of discrete cushioning elements. The cushioning element may comprise a plurality of discrete cushioning elements spaced around the circumference of the flux concentrator. The cushioning element may comprise a plurality of discrete cushioning elements spaced along the length of the flux concentrator.

In certain embodiments, the cushioning element extends around substantially the entire circumference of the flux concentrator. In such embodiments, the cushioning element may comprise one or more resilient O-rings extending around the outer circumference of the flux concentrator. In preferred embodiments, the cushioning element is bonded to substantially the entire outer surface of the flux concentrator. In particularly preferred embodiments, the flux concentrator is encased within the cushioning element.

Also provided is a kit comprising an aerosol-generating device according to the fourth aspect of the invention and a plurality of inductor assemblies according to the sixth aspect.

According to a seventh aspect of the invention, there is provided an electrically operated aerosol-generating device for heating an aerosol-generating article including an aerosol-forming substrate by heating a susceptor element positioned to heat the aerosol-forming substrate, the device comprising: a device housing defining a chamber for receiving at least a portion of the aerosol-generating article; an inductor comprising an inductor coil disposed around at least a portion of the chamber; and a power source connected to the inductor coil and configured to provide a high frequency electric current to the inductor coil such that, in use, the inductor coil generates a fluctuating electromagnetic field to heat the susceptor element and thereby heat the aerosol-forming substrate, wherein the inductor further comprises a flux concentrator disposed around the inductor coil and configured to distort the fluctuating electromagnetic field, generated by the inductor coil during use, towards the chamber, and wherein the inductor further comprises an electrically conductive shield disposed around the flux concentrator.

The electrically conductive shield is configured to redirect the electromagnetic field away from a region of the inductor which is outside of the shield.

With this arrangement, the shield acts to reduce distortion of the electromagnetic field by electrically conductive or highly magnetically susceptible materials in the immediate vicinity of the device, or in the housing of the device itself. This may allow the electromagnetic field generated by the induction coil to be more consistent. It may also allow the inductor to be calibrated for a certain desired level of performance without the need to take into account the material from which the outer housing of the device is made. For example, the metal shield may allow the same configuration of inductor to produce substantially the same results if used in a device with a plastic housing or if used in a device with a metal housing. In other words, the provision of the electrically conductive shield means that the influence of the device housing on the electromagnetic field generated by the induction coil is negligible.

The shield may comprise, or be formed from, any suitable electrically conductive material. For example, the shield may be formed from an electrically conductive polymer. The electrically conductive shield may be a metal shield. For example, the electrically conductive shield may be a metal foil extending around the flux concentrator. The shield may be an electrically conductive coating applied to a component extending around the flux concentrator. For example, the shield may be a metal coating applied to a surface of a non-metal sleeve extending around the flux concentrator. The metal coating may be applied in any suitable manner, for example as a metal paint, a metal ink, or by a vapour deposition process. In preferred embodiments, the electrically conductive shield is applied on the outer surface of the flux concentrator as an electrically conductive foil, an electrically conductive coating, or both.

Preferably, the shield is formed from a material having a relative magnetic permeability of at least 5, preferably at least 20, at a frequency of between 6 and 8 MHz and a temperature of 25 degrees Celsius.

Preferably the shield is formed from a material having a resistivity of at least $1\times10^{-2}$ Ωm, preferably at least $1\times10^{-4}$ Ωm, more preferably at least $1\times10^{-6}$ Ωm.

Suitable materials for the shield include aluminium, copper, tin, steel, gold, silver, or any combination thereof. Preferably, the shield comprises aluminium or copper.

According to an eighth aspect of the present invention, there is provided an electrically operated aerosol-generating system comprising an electrically operated aerosol-generating device according to any of the embodiments described above in relation to the fourth aspect of the invention, an aerosol-generating article including an aerosol-forming substrate, and a susceptor element positioned to heat the aerosol-forming substrate during use, wherein the aerosol-generating article is at least partially received in the chamber and arranged therein such that the susceptor element is inductively heatable by the inductor of the aerosol-generating device to heat the aerosol-forming substrate of the aerosol-generating article received in the chamber.

According to a ninth aspect of the present invention, there is provided an inductor assembly for an electrically operated aerosol-generating device, the inductor assembly defining a chamber for receiving at least a portion of an aerosol-generating article and comprising an inductor coil disposed around at least a portion of the chamber, a flux concentrator disposed around the inductor coil and configured to distort a fluctuating electromagnetic field generated by the inductor coil during use towards the chamber, and an electrically conductive shield disposed around the flux concentrator. The shield is configured to redirect the electromagnetic field away from a region outside of the inductor assembly.

Also provided is a kit comprising an aerosol-generating device according to the seventh aspect of the invention and a plurality of inductor assemblies according to the ninth aspect.

Features described in relation to one or more aspects may equally be applied to other aspects of the invention. In particular, features described in relation to the device of the first aspect may be equally applied to the devices of the fourth and seventh aspects, to the systems of the second, fifth and eighth aspects, and to the inductor assemblies of the third, sixth and ninth aspects, and vice versa.

The invention is further described, by way of example only, with reference to the accompanying drawings in which.

Figure 1:
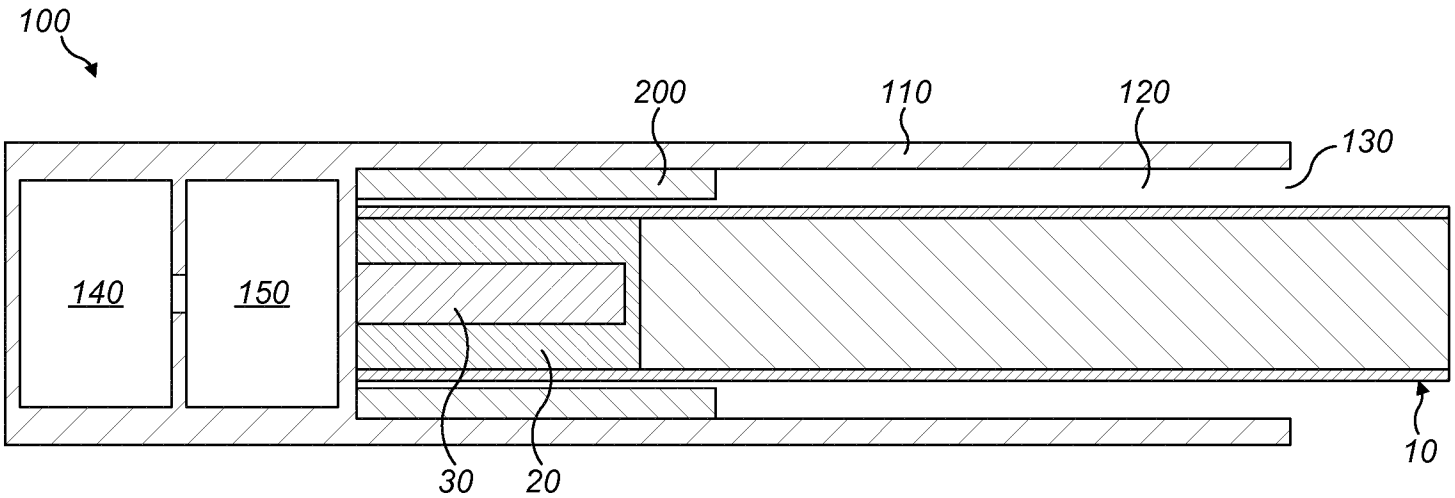
FIG. 1 is a schematic longitudinal cross-section of an electrically-operated aerosol-generating system in accordance with the present invention.

FIG. 1 shows a schematic cross-sectional illustration of an electrically-operated aerosol-generating device 100 and an aerosol-generating article 10 that together form an electrically-operated aerosol-generating system. The electrically-operated aerosol generating device 100 comprises a device housing 110 defining a chamber 120 for receiving the aerosol-generating article 10. The proximal end of the housing 110 has an insertion opening 130 through which the aerosol-generating article 10 may be inserted into and removed from the chamber 120. An inductor 200 is arranged inside the device 100 between an outer wall of the housing 110 and the chamber 120. The inductor 200 includes a helical inductor coil having a magnetic axis corresponding to the longitudinal axis of the chamber 120, which, in this embodiment, corresponds to the longitudinal axis of the device 100. As shown in FIG. 1, the inductor 200 is located adjacent to a distal portion of the chamber 120 and, in this embodiment, extends along part of the length of the chamber 120. In other embodiments, the inductor 200 may extend along all, or substantially all, of the length of the chamber 120, or may extend along part of the length of the chamber 120 and be located away from the distal portion of the chamber 120, for example adjacent to a proximal portion of the chamber 120. The inductor 200 is further described below in relation to FIG. 2.

The device 100 also includes an internal electric power source 140, for example a rechargeable battery, and electronics 150, for example a printed circuit board with circuitry, both located in a distal region of the housing 110. The electronics 150 and the inductor 200 both receive power from the power source 140 via electrical connections (not shown) extending through the housing 110. Preferably, the chamber 120 is isolated from the inductor 200 and the distal region of the housing 110, which contains the power source 140 and the electronics 150, by a fluid-tight separation. Thus, electric components within the device 100 may be kept separate from aerosol or residues produced within the chamber 120 by the aerosol generating process. This may also facilitate cleaning of the device 100, since the chamber 120 may be completely empty when no aerosol-generating article is present. It may also reduce the risk of damage to the device, either during insertion of an aerosol-generating article or during cleaning, since no potentially fragile elements are exposed within the chamber 120. Ventilation holes (not shown) may be provided in the walls of the housing 110 to allow airflow into the chamber 120.

The aerosol-forming article 10 includes an aerosol-forming segment 20 containing an aerosol-forming substrate, for example a plug comprising tobacco material and an aerosol former, and a susceptor element 30 for heating the aerosol-forming substrate 20. The susceptor 30 is arranged within the aerosol-generating article such that it is inductively heatable by the inductor 200 when the aerosol-forming article 10 is received in the chamber 120, as shown in FIG. 1.

When the device 100 is actuated, a high-frequency alternating current is passed through the inductor coil of the inductor 200. This causes the inductor 200 to generate a fluctuating electromagnetic field within the distal portion of the chamber 120 of the device 100. The electromagnetic field preferably fluctuates with a frequency of between 1 and 30 MHz, preferably between 2 and 10 MHz, for example between 5 and 7 MHz. When an aerosol-generating article 10 is correctly located in the chamber 120, the susceptor 30 of the article 10 is located within this fluctuating electromagnetic field. The fluctuating field generates eddy currents within the susceptor 30, which is heated as a result. Further heating is provided by magnetic hysteresis losses within the susceptor 30. The heated susceptor 30 heats the aerosol-forming substrate 20 of the aerosol-generating article 10 to a sufficient temperature to form an aerosol. The aerosol may then be drawn downstream through the aerosol-generating article 10 for inhalation by the user. Such actuation may be manually operated or may occur automatically in response to a user drawing on the aerosol-generating article 10.

Figure 2:
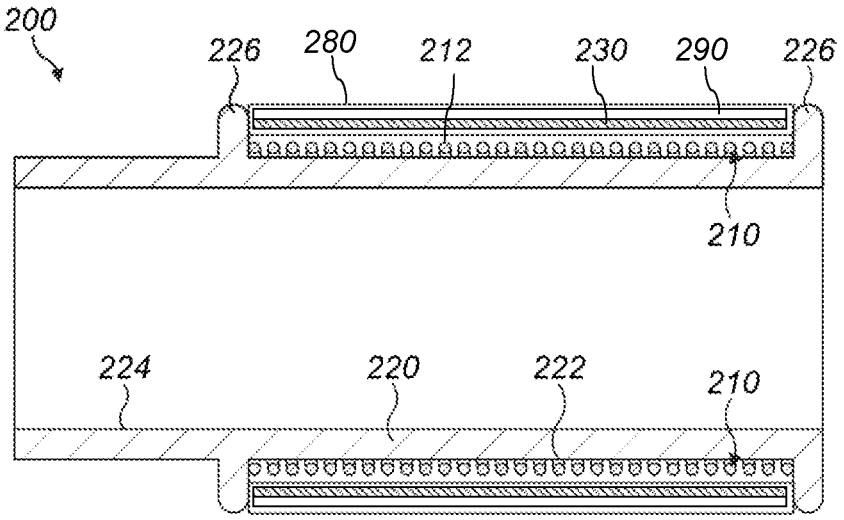
FIG. 2 is a longitudinal cross-sectional illustration of a first embodiment of inductor for the aerosol-generating system of FIG. 1.
Figure 3:
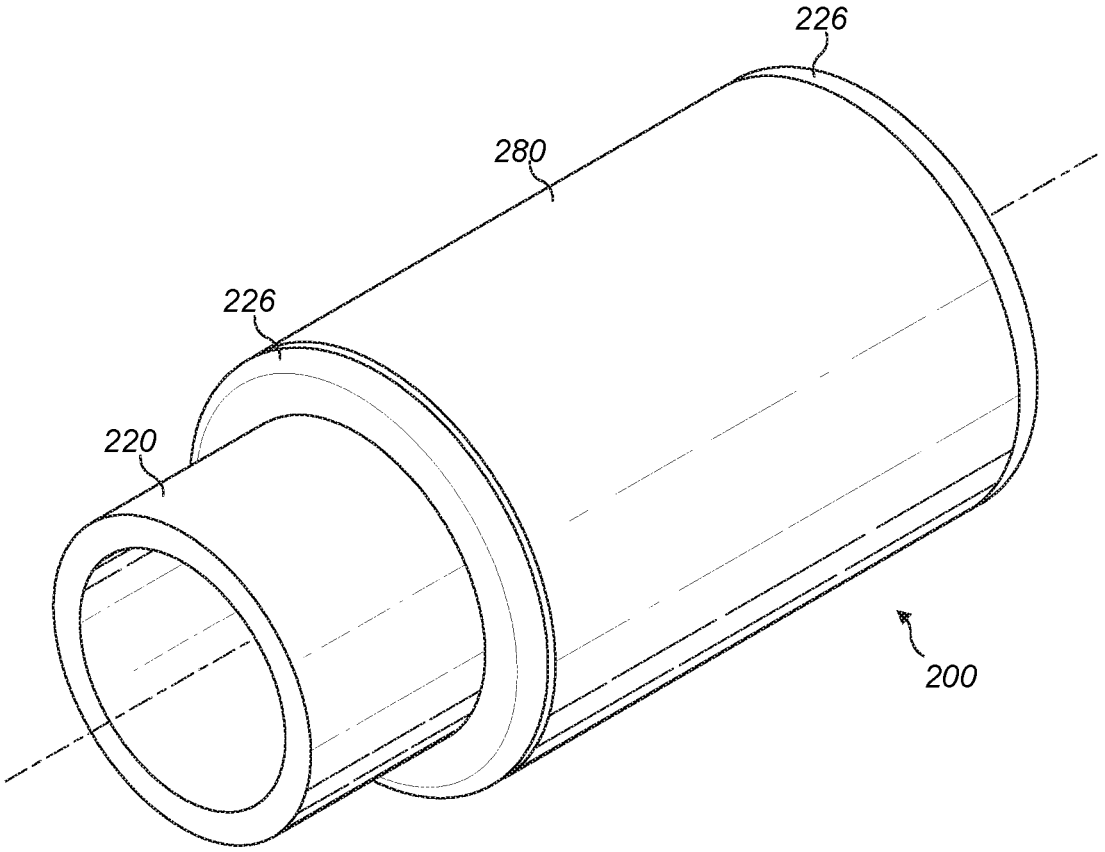
FIG. 3 is a perspective view of the inductor of FIG. 2.

Referring to FIG. 2 and FIG. 3, the inductor 200 is tubular and comprises a helically wound, cylindrical inductor coil 210 surrounding a tubular inner sleeve 220. Both the inductor coil 210 and the inner sleeve 220 are surrounded by a tubular flux concentrator 230 which extends along the length of the inductor coil 210. The inductor 200 may further include a cushioning element 280 within which the flux concentrator 230 is encased to provide shock resistance to the flux concentrator. The cushioning element 280 is in the form of a sleeve of silicone rubber within which the flux concentrator is held. The inductor 200 may further include an electrically conductive shield 290 disposed around the flux concentrator 230 and also encased within the cushioning element 280. The shield is configured to redirect the electromagnetic field away from a region outside of the inductor 200. The electrically conductive shield 290 is provided as a metal coating deposited on an outer surface of the flux concentrator such that it extends over substantially the entire outer surface of the flux concentrator.

The inductor coil 210 is formed from a wire 212 and has a plurality of turns, or windings, extending along its length. The wire 212 may have any suitable cross-sectional shape, such as square, oval, or triangular. In this embodiment, the wire 212 has a circular cross-section. In other embodiments, the wire may have a flat cross-sectional shape. For example, the inductor coil may be formed from a wire having a rectangular cross-sectional shape and wound such that the maximum width of the cross-section of the wire extends parallel to the magnetic axis of the inductor coil. Such flat inductor coils may allow the outer diameter of the inductor, and therefore the outer diameter of the device, to be minimized.

The inner sleeve 220 has an outer surface 222, on which the inductor coil is disposed, and an inner surface 224. The inner surface 224 defines the side walls of the chamber of the device in the distal region of the chamber. In this manner, the inductor coil 210 surrounds the chamber along at least a part of its length. The outer surface 222 has a pair of annular protrusions 226 extending around the circumference of the inner sleeve 220. The protrusions 226 are located at either end of the inductor coil 210 to retain the coil 210 in position on the inner sleeve 220. The inner sleeve may be made from any suitable material, such as a plastic.

Figure 4A:
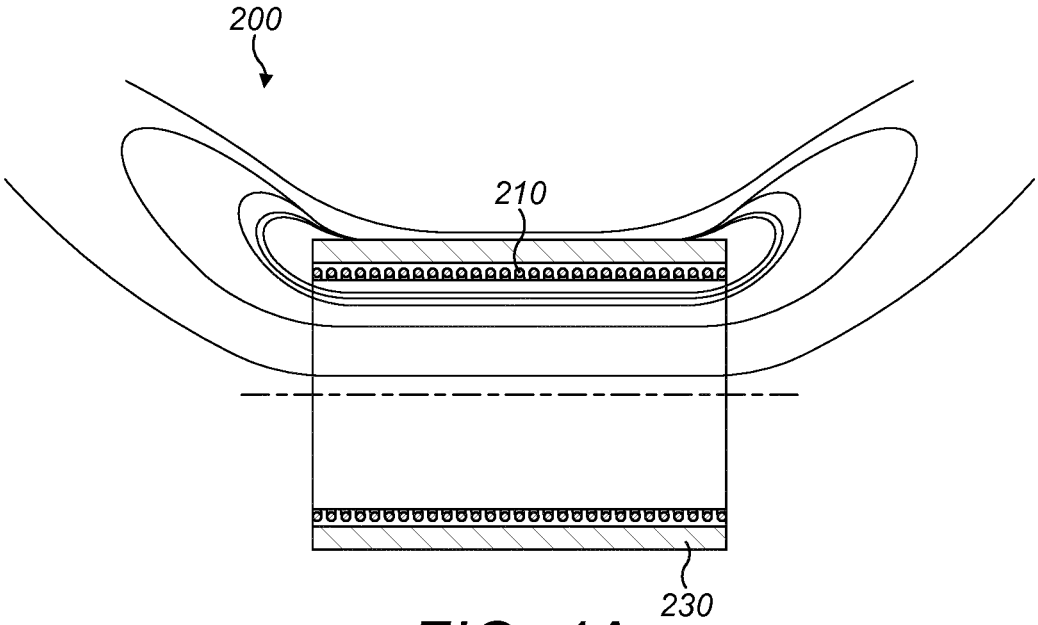
FIG. 4A is a longitudinal cross-sectional illustration of the inductor of FIG. 2 in which an example electromagnetic field generated in the upper half of the inductor is illustrated and in which the inner sleeve is omitted for clarity.
Figure 4B:
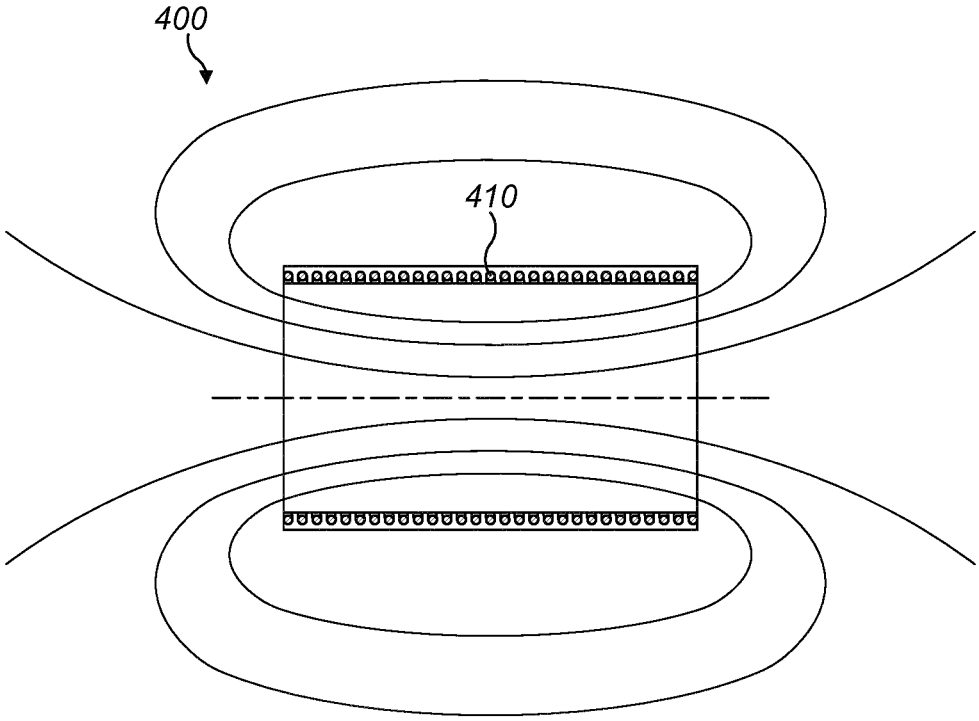
FIG. 4B is a longitudinal cross-sectional illustration of a prior art inductor in which example electromagnetic field generated in the upper half of the inductor is illustrated.

The flux concentrator 230 is fixed around the inductor coil 210 and is also retained in position by the protrusions 226 on the outer surface 222 of the sleeve 220. The flux concentrator 230 is formed from a material having a high relative magnetic permeability so that the electromagnetic field produced by the inductor coil 210 is attracted to and guided by the flux concentrator 230. This is illustrated with reference to FIG. 4A, which illustrates the electromagnetic field lines generated by the upper portion of the inductor 200 of the first embodiment and FIG. 4B, which illustrates the electromagnetic field lines generated by the upper portion of a prior art inductor 400 having an inductor coil 410 and no flux concentrator. Comparing FIG. 4A with FIG. 4B, it can be seen that the electromagnetic field is distorted by the flux concentrator 230 so that the electromagnetic field lines do not propagate beyond the outer diameter of the inductor 200 to the same extent as with the inductor 400 of FIG. 4B. Thus, the flux concentrator 230 acts as a magnetic shield. This may reduce undesired heating of or interference with external objects relative to the prior art inductor 400. The electromagnetic field lines within the inner volume defined by the inductor 200 are also distorted by flux concentrator so that the density of the electromagnetic field within the chamber is increased. This may increase the current generated within a susceptor located in the chamber. In this manner, the electromagnetic field can be concentrated towards the chamber to allow for more efficient heating of the susceptor. The flux concentrator 230 may be made from any suitable material or materials having a high relative magnetic permeability. For example, the flux concentrator may be formed from one or more ferromagnetic materials, for example a ferrite material, a ferrite powder held in a binder, or any other suitable material including ferrite material such as ferritic iron, ferromagnetic steel or stainless steel.

Figure 5:
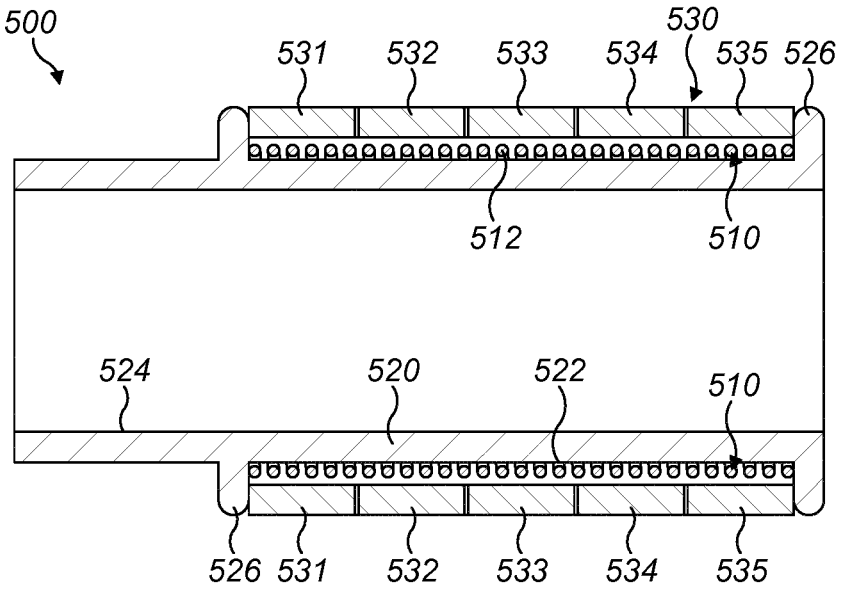
FIG. 5 is longitudinal cross-sectional illustration of a second embodiment of inductor for the aerosol-generating system of FIG. 1.
Figure 6:
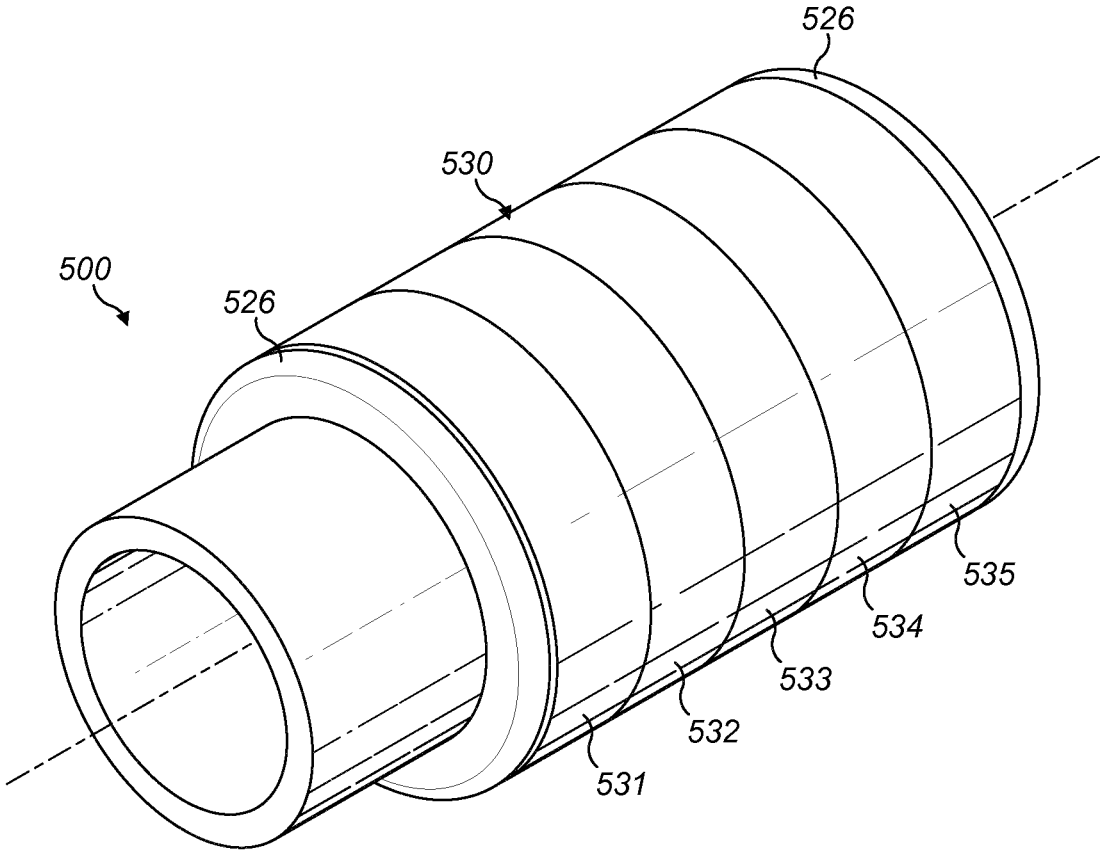
FIG. 6 is a perspective view of the inductor of FIG. 5.

The flux concentrator is preferably made from a material or materials having a high relative magnetic permeability. That is, a material having a relative magnetic permeability of at least 5 when measured at 25 degrees Celsius, for example, at least 10, at least 20, at least 30, at least 40, at least 50, at least 60, at least 80, or at least 100. These example values may refer to the relative magnetic permeability of the flux concentrator material for a frequency of between 6 and 8 MHz and a temperature of 25 degrees Celsius. In this embodiment, the flux concentrator is a unitary component. In other embodiments, the flux concentrator may be formed from layers of sheet material, or from a plurality of discrete segments as described below in relation to FIG. 5 to FIG. 9. In this example, the thickness of the flux concentrator is substantially constant along its length and is selected based on the material used for the flux concentrator and for the amount of electromagnetic field distortion required. For example, where the flux concentrator is made from ferrite, the thickness may be in the region of 0.3 mm to 5 mm, preferably from 0.5 mm to 1.5 mm. FIG. 5 and FIG. 6 illustrate an inductor 500 according to a second embodiment. The inductor 500 of the second embodiment is similar in construction and operation to the first embodiment of inductor 200 shown in FIG. 1 to FIG. 4A, and where the same features are present, like reference numerals have been used. However, unlike the inductor 200 of the first embodiment, in the inductor 500 of the second embodiment, the flux concentrator 530 is not a unitary component but is instead formed from a plurality of flux concentrator segments 531, 532, 533, 534, 535 positioned adjacent to one another. The flux concentrator segments 531, 532, 533, 534, 535 are tubular and are positioned coaxially along the length of the flux concentrator 530. In this example, the flux concentrator segments have a circular, cylindrical shape. Consequently, the flux concentrator 530 also has a circular, cylindrical shape. However, it will be appreciated that other shapes may be achieved by selecting a different shape for one or more of the flux concentrator segments. In this example, the flux concentrator segments are positioned directly adjacent to one another so that they are in abutting coaxial alignment. In other examples, two or more of the flux concentrator segments may be separated from an adjacent flux concentrator segment by a gap.

Advantageously, the use of discrete flux concentrator segments to form the flux concentrator 530 allows the flux concentrator to be assembled using different segments having different relative magnetic permeability values. For example, the flux concentrator may be formed from one or more flux concentrator segments made from a first material having a first relative magnetic permeability and one or more flux concentrator segments made from a second material having a second relative magnetic permeability. This allows the flux concentrator to be "fine-tuned" during assembly to achieve a desired level of induction from the inductor coil and a desired level of electromagnetic flux in the chamber where the susceptor of the aerosol-generating article will be located during use. Each of the flux concentrator segments could be made from a different material, or from the same material, or from any number of combinations in between.

As with the inductor 200 of the first embodiment, the inductor 500 includes an inner sleeve 520 having a plurality of protrusions 526 on its outer surface 522 by which the inductor coil 510 and the flux concentrator 530 are retained in position.

Also as with the inductor 200 of the first embodiment, the inductor 500 may further include a cushioning element (not shown) within which the discrete segments of the flux concentrator 530 is encased to provide shock resistance to the flux concentrator, and may further include an electrically conductive shield disposed around the flux concentrator 530 and configured to redirect the electromagnetic field away from a region outside of the inductor 500. As the flux concentrator 530 is provided as a plurality of discrete segments, so too are the electrically conductive shield and the cushioning element. This allows the flux concentrator to be fine-tuned by swapping flux concentrator segments together with their corresponding electrically conductive shield segments and cushioning element segments.

Figure 7:
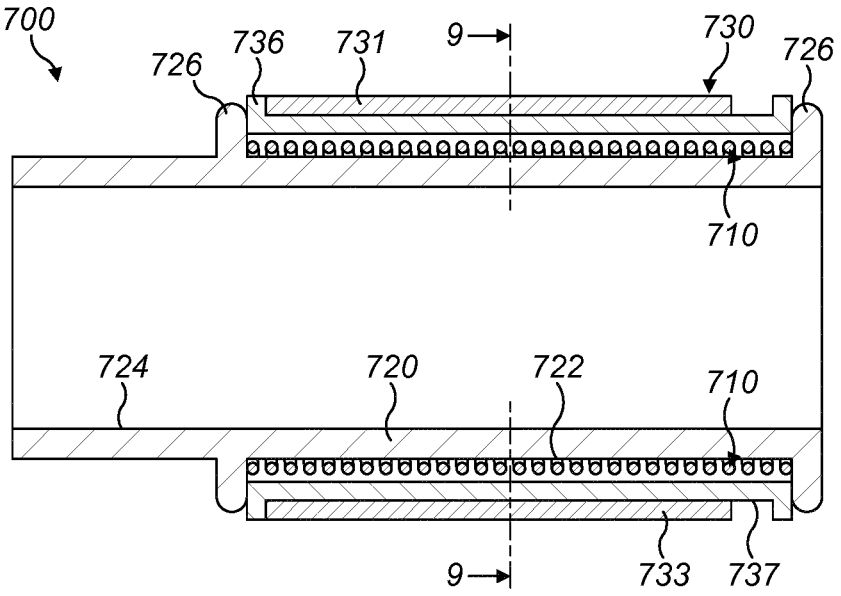
FIG. 7 is longitudinal cross-sectional illustration of a third embodiment of inductor for the aerosol-generating system of FIG. 1.
Figure 8:
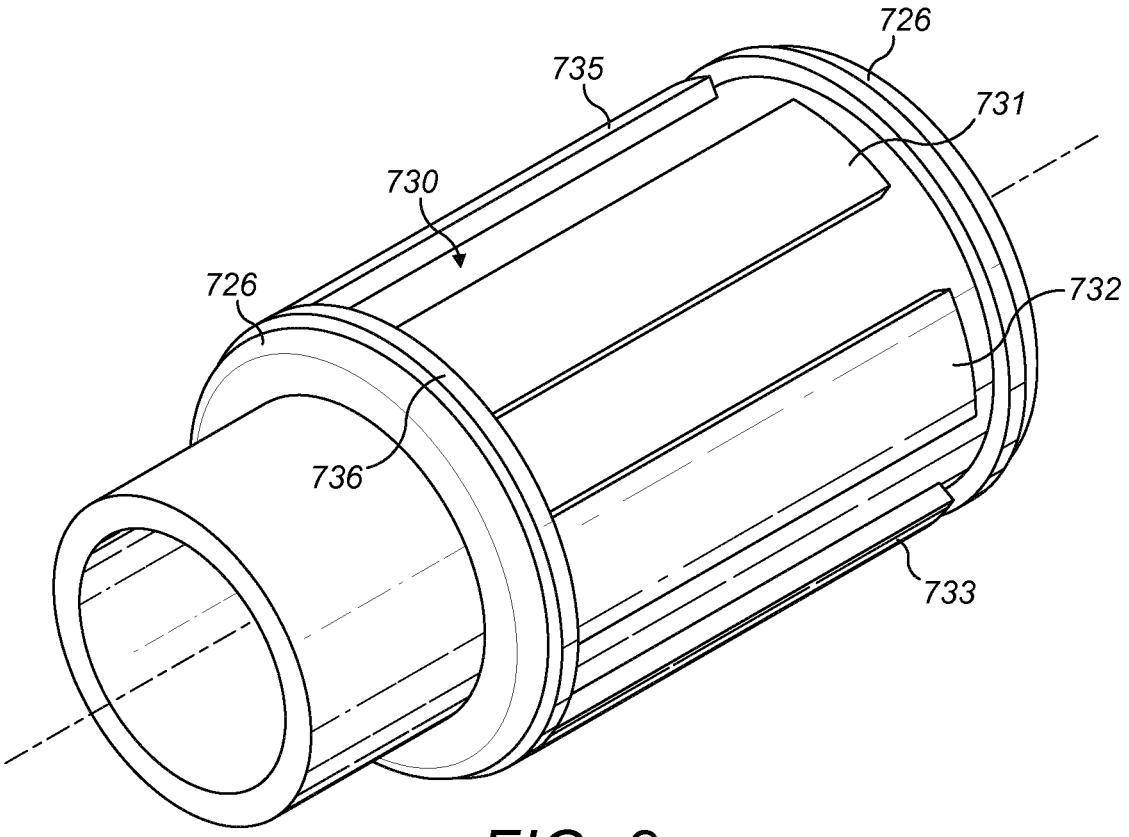
FIG. 8 is a perspective view of the inductor of FIG. 7.
Figure 9:
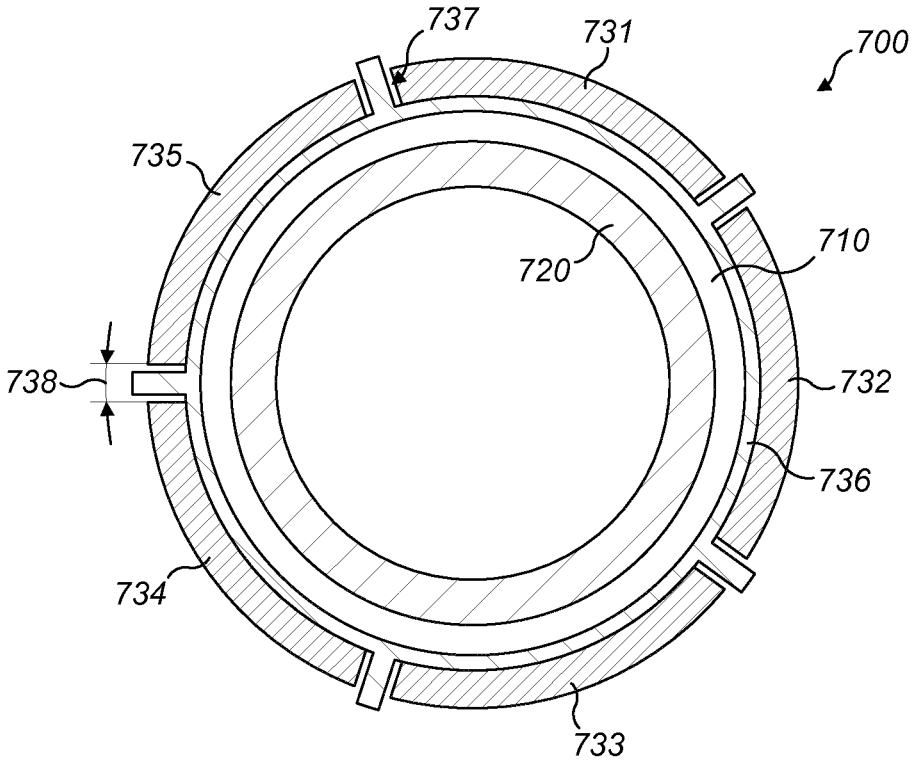
FIG. 9 is a cross-sectional illustration of the inductor of FIG. 7 taken along line 9-9.

FIG. 7 to FIG. 9 illustrate an inductor 700 according to a third embodiment. The inductor 700 of the third embodiment is similar in construction and operation to the first and second embodiments of inductor shown in FIG. 1 to FIG. 6, and where the same features are present, like reference numerals have been used. As with the inductor 500 of the second embodiment, the flux concentrator 730 is not a unitary component but is instead formed from a plurality of flux concentrator segments 731, 732, 733, 734, 735 positioned adjacent to one another. Unlike the flux concentrator 530 of the second embodiment, the flux concentrator segments 731, 732, 733, 734, 735 are elongate and are positioned around the circumference of the flux concentrator 730 such that their longitudinal axes are substantially parallel with the magnetic axis of the inductor coil 710. The flux concentrator 730 further comprises an outer sleeve 736 which circumscribes the inductor coil 710 and is used to retain the flux concentrator segments in position. To this end, the outer sleeve 736 includes a plurality of longitudinal slots 737 within which the flux concentrator segments are slidably held. In this embodiment, the outer sleeve 736 has a circular, cylindrical shape and the flux concentrator segments have an arc-shaped cross-section corresponding to the outer shape of the outer sleeve. Consequently, the flux concentrator 730 also has a circular, cylindrical shape. However, it will be appreciated that other shapes may be achieved by selecting a different shape for the outer sleeve and for the flux concentrator segments. The longitudinal slots 737 have a length which is greater than the length of the flux concentrator segments. As a result, the flux concentrator segments may each be slid within their respective slot 737 to vary their respective longitudinal position while remaining within their respective slots. This allows the electromagnetic field to be tuned by varying the longitudinal position of one or more of the elongate flux concentrator segments. In this embodiment, the elongate flux concentrator segments have a substantially constant thickness. In other embodiments, the elongate flux concentrator segments may be wedge shaped. That is, the thickness of each of the flux concentrator segments may increase along its length from one of its ends to the other. This allows for further tuning of the electromagnetic field by adjusting the longitudinal position of one or more of the elongate flux concentrator segments in its respective slot according to the desired level of induction.

In this example, the flux concentrator segments are arranged on the outer sleeve 736 such that they are separated by a narrow gap 738. In other examples, two or more of the flux concentrator segments may be in direct contact with one or both of the flux concentrator segments on either of its sides.

As with the inductors 200, 500 of the first and second embodiments, the inductor 700 includes an inner sleeve 720 having a plurality of protrusions 726 on its outer surface 722 by which the inductor coil 710 and the flux concentrator 730 are retained in position. The protrusions 726 are positioned either side of the inductor coil 710 and the outer sleeve 736 and retain the flux concentrator 730 in position by preventing longitudinal movement of the outer sleeve 736.

Also as with the inductors 200 and of the first and second embodiments, the inductor 700 may further include a cushioning element (not shown) within which the discrete segments of the flux concentrator 570 are encased to provide shock resistance to the flux concentrator, and may further include an electrically conductive shield disposed around the flux concentrator 730 and configured to redirect the electromagnetic field away from a region outside of the inductor 700. As the flux concentrator 730 is provided as a plurality of discrete segments, so too are the electrically conductive shield and the cushioning element. This allows the flux concentrator to be fine-tuned by swapping flux concentrator segments together with their corresponding electrically conductive shield segments and cushioning element segments.

The use of discrete flux concentrator segments to form the flux concentrator 730 allows the flux concentrator to be assembled using different segments having different relative magnetic permeability values. For example, the flux concentrator may be formed from one or more elongate flux concentrator segments made from a first material having a first relative magnetic permeability and one or more elongate flux concentrator segments made from a second material having a second relative magnetic permeability. This allows the flux concentrator to be "fine-tuned" during assembly to achieve a desired level of induction from the inductor coil and a desired level of electromagnetic flux in the chamber where the susceptor of the aerosol-generating article will be located during use. To this end, each of the elongate flux concentrator segments could be made from a different material, or from the same material, or from any number of combinations in between.

The exemplary embodiments described above are not intended to limit the scope of the claims. Other embodiments consistent with the exemplary embodiments described above will be apparent to those skilled in the art.

For example, in the embodiments described above, the inductor comprises an inner sleeve forming the side walls of the chamber and around which the inductor coil is wound. In such embodiments, the tubular sleeve may be an integral part of the housing or may be removable from the housing, along with the rest of the inductor. In other embodiments, the inductor coil and the flux concentrator may be embedded within the housing of the device, for example moulded into the material from which the housing is formed. In such embodiments, the inner sleeve is not required.

In this embodiments described above, the flux concentrator in each case is, broadly speaking, a cylindrical annulus. That is, the flux concentrator has a circular cross-section and a substantially uniform thickness along its length. However, it will be understood that the flux concentrator may have any suitable shape and this may depend, for instance, on the shape of the inductor coil and the shape of the desired electromagnetic field. For example, the flux concentrator may have a square, oblong, or rectangular cross section. The flux concentrator may also vary in thickness along its length, or around its circumference. For example, the thickness of the flux concentrator may uniformly taper towards one or both of its ends.

Additionally, the flux concentrator has been described as a unitary component or as being formed from a plurality of tubular flux concentrator segments or elongate flux concentrator segments. However, it will be understood that the flux concentrator segments may have any suitable shape or arrangement. For example, the flux concentrator may comprise a combination of both elongate flux concentrator segments and tubular flux concentrator segments.

The invention claimed is:

1. An electrically operated aerosol-generating device for heating an aerosol-generating article including an aerosol-forming substrate by heating a susceptor element positioned to heat the aerosol-forming substrate, the device comprising:

a device housing defining a chamber configured to receive at least a portion of the aerosol-generating article;

an inductor comprising an inductor coil disposed around at least a portion of the chamber; and a power source connected to the inductor coil and configured to provide a high-frequency electric current to the inductor coil to generate a fluctuating electromagnetic field to heat the susceptor element and thereby heat the aerosol-forming substrate, wherein the inductor further comprises a flux concentrator disposed around the inductor coil and configured to distort the fluctuating electromagnetic field toward the chamber, and wherein the flux concentrator comprises a plurality of discrete flux concentrator segments positioned adjacent to one another.

2. The electrically operated aerosol-generating device according to claim 1, wherein the flux concentrator is formed from a material or materials having a relative magnetic permeability of at least 5, at a frequency of between 6 MHz and 8 MHz, and a temperature of 25 degrees Celsius.

3. The electrically operated aerosol-generating device according to claim 1, wherein the flux concentrator comprises a ferromagnetic material or materials.

4. The electrically operated aerosol-generating device according to claim 1, wherein the flux concentrator has a thickness of from 0.3 mm to 5 mm.

5. The electrically operated aerosol-generating device according to claim 1, wherein the flux concentrator has a thickness that varies along a length thereof, or varies around a circumference thereof, or varies both along the length and around the circumference.

6. The electrically operated aerosol-generating device according to claim 1, wherein the plurality of flux concentrator segments includes a first flux concentrator segment formed from a first material and a second flux concentrator segment formed from a second, different material, and wherein the first and second materials have different values of relative magnetic permeability.

7. The electrically operated aerosol-generating device according to claim 1, wherein the plurality of flux concentrator segments are tubular and are positioned coaxially along a length of the flux concentrator.

8. The electrically operated aerosol-generating device according to claim 1, wherein the plurality of flux concentrator segments are elongate and are positioned around a circumference of the flux concentrator.

9. The electrically operated aerosol-generating device according to claim 8, wherein the plurality of elongate flux concentrator segments are arranged such that longitudinal axes thereof are substantially parallel with a magnetic axis of the inductor coil.

10. The electrically operated aerosol-generating device according to claim 8, wherein the inductor further comprises an outer sleeve circumscribing the inductor coil and has a plurality of longitudinal slots in which the elongate flux concentrator segments are held.

11. The electrically operated aerosol-generating device according to claim 10, wherein the elongate flux concentrator segments are slidably held in the longitudinal slots such that a longitudinal position of the elongate flux concentrator segments relative to the inductor coil may be selectively varied.

12. The electrically operated aerosol-generating device according to claim 1, wherein the inductor further comprises an inner sleeve having an outer surface on which the inductor coil is supported.

13. The electrically operated aerosol-generating device according to claim 12, wherein the inner sleeve comprises protrusions on an outer surface thereof at one or both ends of the inductor coil being configured to retain the inductor coil on the inner sleeve.

14. An electrically operated aerosol-generating system comprising an electrically operated aerosol-generating device according to claim 1, an aerosol-generating article including an aerosol-forming substrate, and a susceptor element positioned to heat the aerosol-forming substrate, wherein the aerosol-generating article is at least partially received in the chamber and arranged therein such that the susceptor element is inductively heatable by the inductor of the aerosol-generating device to heat the aerosol-forming substrate of the aerosol-generating article.

15. The electrically operated aerosol-generating system according to claim 14, wherein the aerosol-forming substrate comprises a tobacco-containing material including volatile tobacco flavor compounds that are released from the aerosol-forming substrate upon heating.

16. An inductor assembly for an electrically operated aerosol-generating device, the inductor assembly defining a chamber configured to receive at least a portion of an aerosol-generating article and comprising:

an inductor coil disposed around at least a portion of the chamber; and a flux concentrator disposed around the inductor coil and configured to distort a fluctuating electromagnetic field generated by the inductor coil toward the chamber, wherein the flux concentrator comprises a plurality of discrete flux concentrator segments positioned adjacent to one another.

17. An electrically operated aerosol-generating device for heating an aerosol-generating article including an aerosol-forming substrate by heating a susceptor element positioned to heat the aerosol-forming substrate, the device comprising:

a device housing defining a chamber configured to receive at least a portion of the aerosol-generating article;

an inductor comprising an inductor coil disposed around at least a portion of the chamber; and a power source connected to the inductor coil and configured to provide a high-frequency electric current to the inductor coil such that the inductor coil generates a fluctuating electromagnetic field to heat the susceptor element and thereby heat the aerosol-forming substrate, wherein the inductor further comprises a flux concentrator disposed around the inductor coil and configured to distort the fluctuating electromagnetic field toward the chamber, and wherein the inductor further comprises a cushioning element positioned between the flux concentrator and the device housing.

18. The electrically operated aerosol-generating device according to claim 17, wherein the cushioning element extends around substantially an entire circumference of the flux concentrator.

19. The electrically operated aerosol-generating device according to claim 17, wherein the cushioning element is bonded to substantially an entire outer surface of the flux concentrator.

20. The electrically operated aerosol-generating device according to claim 17, wherein the flux concentrator is encased within the cushioning element.

21. The electrically operated aerosol-generating device according to claim 17, wherein the cushioning element is formed from silicone, or from an epoxy resin, or from rubber or another elastomer, or from any combination thereof.

22. The electrically operated aerosol-generating device according to claim 17, wherein the flux concentrator is formed from a material or materials having a relative magnetic permeability of at least 5, at a frequency of between 6 MHz and 8 MHz, and a temperature of 25 degrees Celsius.

23. The electrically operated aerosol-generating device according to claim 17, wherein the flux concentrator comprises a ferromagnetic material or materials.

24. The electrically operated aerosol-generating device according to claim 17, wherein the flux concentrator has a thickness of from 0.3 mm to 5 mm.

25. The electrically operated aerosol-generating device according to claim 17, wherein the flux concentrator has a thickness that varies along a length thereof, or varies around a circumference thereof, or varies both along the length and around the circumference.

26. The electrically operated aerosol-generating device according to claim 17, wherein the flux concentrator comprises a plurality of discrete flux concentrator segments positioned adjacent to one another.

27. The electrically operated aerosol-generating device according to claim 26, wherein the plurality of flux concentrator segments includes a first flux concentrator segment formed from a first material and a second flux concentrator segment formed from a second, different material, and wherein the first and second materials have different values of relative magnetic permeability.

28. The electrically operated aerosol-generating device according to claim 26, wherein the plurality of flux concentrator segments are tubular and are positioned coaxially along a length of the flux concentrator.

29. The electrically operated aerosol-generating device according to claim 26, wherein the plurality of flux concentrator segments are elongate and are positioned around a circumference of the flux concentrator.

30. The electrically operated aerosol-generating device according to claim 29, wherein the plurality of elongate flux concentrator segments are arranged such that longitudinal axes thereof are substantially parallel with a magnetic axis of the inductor coil.

31. The electrically operated aerosol-generating device according to claim 29, wherein the inductor further comprises an outer sleeve circumscribing the inductor coil and has a plurality of longitudinal slots in which the elongate flux concentrator segments are held.

32. The electrically operated aerosol-generating device according to claim 31, wherein the elongate flux concentrator segments are slidably held in the longitudinal slots such that a longitudinal position of the elongate flux concentrator segments relative to the inductor coil may be selectively varied.

33. The electrically operated aerosol-generating device according to claim 17, wherein the inductor further comprises an inner sleeve having an outer surface on which the inductor coil is supported.

34. The electrically operated aerosol-generating device according to claim 33, wherein the inner sleeve comprises protrusions on an outer surface thereof at one or both ends of the inductor coil configured to retain the inductor coil on the inner sleeve.

35. An electrically operated aerosol-generating system comprising an electrically operated aerosol-generating device according to claim 17, an aerosol-generating article including an aerosol-forming substrate, and a susceptor element positioned to heat the aerosol-forming substrate, wherein the aerosol-generating article is at least partially received in the chamber and arranged therein such that the susceptor element is inductively heatable by the inductor of the aerosol-generating device to heat the aerosol-forming substrate of the aerosol-generating article.

36. The electrically operated aerosol-generating system according to claim 35, wherein the aerosol-forming substrate comprises a tobacco-containing material including volatile tobacco flavor compounds that are released from the aerosol-forming substrate upon heating.

37. An inductor assembly for an electrically operated aerosol-generating device, the inductor assembly defining a chamber configured to receive at least a portion of an aerosol-generating article and comprising:

an inductor coil disposed around at least a portion of the chamber;

a flux concentrator disposed around the inductor coil and configured to distort a fluctuating electromagnetic field generated by the inductor coil toward the chamber; and a cushioning element positioned on an outer surface of the flux concentrator.

38. An electrically operated aerosol-generating device for heating an aerosol-generating article including an aerosol-forming substrate by heating a susceptor element positioned to heat the aerosol-forming substrate, the device comprising:

a device housing defining a chamber configured to receive at least a portion of the aerosol-generating article;

an inductor comprising an inductor coil disposed around at least a portion of the chamber; and a power source connected to the inductor coil and configured to provide a high frequency electric current to the inductor coil to generate a fluctuating electromagnetic field to heat the susceptor element and thereby heat the aerosol-forming substrate, wherein the inductor further comprises a flux concentrator disposed around the inductor coil and configured to distort the fluctuating electromagnetic field toward the chamber, an electrically conductive shield disposed around the flux concentrator, and an inner sleeve having an outer surface on which the inductor coil is supported, the inner sleeve comprising protrusions on an outer surface thereof at one or both ends of the inductor coil configured to retain the inductor coil on the inner sleeve.

39. The electrically operated aerosol-generating device according to claim 38, wherein the electrically conductive shield is a metal foil extending around the flux concentrator, or a metal coating applied to a component extending around the flux concentrator.

40. The electrically operated aerosol-generating device according to claim 38, wherein the electrically conductive shield is formed from a material having a relative magnetic permeability of at least 5, at a frequency of between 6 MHz and 8 MHz, and a temperature of 25 degrees Celsius.

41. The electrically operated aerosol-generating device according to claim 38, wherein the electrically conductive shield is formed from a material having a resistivity of at least $1\times10^{-2}$ Ωm.

42. The electrically operated aerosol-generating device according to claim 38, wherein the flux concentrator is formed from a material or materials having a relative magnetic permeability of at least 5, at a frequency of between 6 MHz and 8 MHz, and a temperature of 25 degrees Celsius.

43. The electrically operated aerosol-generating device according to claim 38, wherein the flux concentrator comprises a ferromagnetic material or materials.

44. The electrically operated aerosol-generating device according to claim 38, wherein the flux concentrator has a thickness of from 0.3 mm to 5 mm.

45. The electrically operated aerosol-generating device according to claim 38, wherein the flux concentrator has a thickness that varies along a length thereof, or varies around a circumference thereof, or varies both along the length and around the circumference.

46. The electrically operated aerosol-generating device according to claim 38, wherein the flux concentrator comprises a plurality of discrete flux concentrator segments positioned adjacent to one another.

47. The electrically operated aerosol-generating device according to claim 46, wherein the plurality of flux concentrator segments includes a first flux concentrator segment formed from a first material and a second flux concentrator segment formed from a second, different material, and wherein the first and second materials have different values of relative magnetic permeability.

48. The electrically operated aerosol-generating device according to claim 46, wherein the plurality of flux concentrator segments are tubular and are positioned coaxially along a length of the flux concentrator.

49. The electrically operated aerosol-generating device according to claim 46, wherein the plurality of flux concentrator segments are elongate and are positioned around a circumference of the flux concentrator.

50. The electrically operated aerosol-generating device according to claim 49, wherein the plurality of elongate flux concentrator segments are arranged such that longitudinal axes thereof are substantially parallel with a magnetic axis of the inductor coil.

51. The electrically operated aerosol-generating device according to claim 49, wherein the inductor further comprises an outer sleeve circumscribing the inductor coil and has a plurality of longitudinal slots in which the elongate flux concentrator segments are held.

52. The electrically operated aerosol-generating device according to claim 51, wherein the elongate flux concentrator segments are slidably held in the longitudinal slots such that a longitudinal position of the elongate flux concentrator segments relative to the inductor coil may be selectively varied.

53. An electrically operated aerosol-generating system comprising an electrically operated aerosol-generating device according to claim 38, an aerosol-generating article including an aerosol-forming substrate, and a susceptor element positioned to heat the aerosol-forming substrate, wherein the aerosol-generating article is at least partially received in the chamber and arranged therein such that the susceptor element is inductively heatable by the inductor of the aerosol-generating device to heat the aerosol-forming substrate of the aerosol-generating article.

54. The electrically operated aerosol-generating system according to claim 53, wherein the aerosol-forming substrate comprises a tobacco-containing material including volatile tobacco flavor compounds that are released from the aerosol-forming substrate upon heating.

55. An inductor assembly for an electrically operated aerosol-generating device, the inductor assembly defining a chamber configured to receive at least a portion of an aerosol-generating article and comprising:

an inductor coil disposed around at least a portion of the chamber;

a flux concentrator disposed around the inductor coil and configured to distort a fluctuating electromagnetic field generated by the inductor coil toward the chamber;

an electrically conductive shield disposed around the flux concentrator; and an inner sleeve having an outer surface on which the inductor coil is supported, the inner sleeve comprising protrusions on an outer surface thereof at one or both ends of the inductor coil configured to retain the inductor coil on the inner sleeve.

* * * * *